United States Patent [19]

Johnston

[11] Patent Number: 4,728,010

[45] Date of Patent: Mar. 1, 1988

[54] KEG TAPPER

[76] Inventor: Mack S. Johnston, 1065 Lomita Blvd., #220, Harbor City, Calif. 90710

[21] Appl. No.: 888,774

[22] Filed: Jul. 22, 1986

[51] Int. Cl.[4] ..... B65D 83/00

[52] U.S. Cl. ..... 222/397; 137/212; 137/522; 222/400.7; 222/400.8; 285/91

[58] Field of Search ..... 222/400.7, 400.8, 397, 222/396, 394, 399, 401, 481.5, 482, 566, 567, 570; 285/9, 401, 404; 403/316, 323; 137/212, 495, 540, 522; 215/273, 283, 280; 220/325, 326; 251/318–324; 251/82, 83

[56] References Cited

U.S. PATENT DOCUMENTS

| | | | |
|---|---|---|---|
| 562,892 | 6/1896 | Gates et al. | 285/404 X |
| 636,457 | 11/1899 | Scott | 215/283 |
| 2,261,834 | 11/1941 | Morgan | 222/567 |
| 2,352,382 | 6/1944 | Hendricks | 215/280 |
| 3,357,601 | 12/1967 | Crawford et al. | 222/397 |
| 3,758,008 | 9/1973 | Johnston | 222/400.7 |
| 3,908,871 | 9/1975 | Gottwald | 222/400.7 |
| 4,159,102 | 6/1979 | Fallon et al. | 222/400.7 X |
| 4,180,189 | 12/1979 | Zurit et al. | 222/400.7 |
| 4,291,821 | 9/1981 | Nezworski | 222/400.7 X |
| 4,350,273 | 9/1982 | Nezworski et al. | 222/400.7 X |
| 4,612,952 | 9/1986 | Fallon | 222/400.7 X |

FOREIGN PATENT DOCUMENTS

| | | | |
|---|---|---|---|
| 2064519 | 7/1972 | Fed. Rep. of Germany | 222/400.7 |

OTHER PUBLICATIONS

IBM Technical Disclosure Bulletin, vol. 19, No. 1, Jun. 1976 (pp. 92 and 93), Mulzet et al.

*Primary Examiner*—Joseph J. Rolla
*Assistant Examiner*—Kevin P. Shaver
*Attorney, Agent, or Firm*—Harris, Kern, Wallen & Tinsley

[57] ABSTRACT

A keg tapper for use with a keg having a neck with a closure valve carried therein and a flange with a tapered edge on the neck. An arrangement for attaching the tapper at the flanged neck so that completion of the attachment opens the inner valve of the keg closure. A plunger carried in the keg tapper with an arrangement for moving the plunger axially within the tapper body to engage the keg closure and open the outer valve. A keg tapper which can be utilized in the tavern configuration and in the picnic configuration.

3 Claims, 9 Drawing Figures

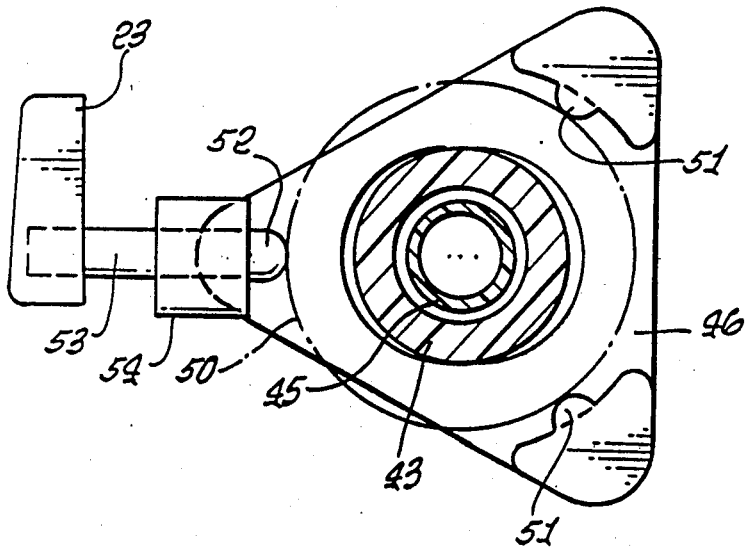
FIG. 5.
FIG. 7.
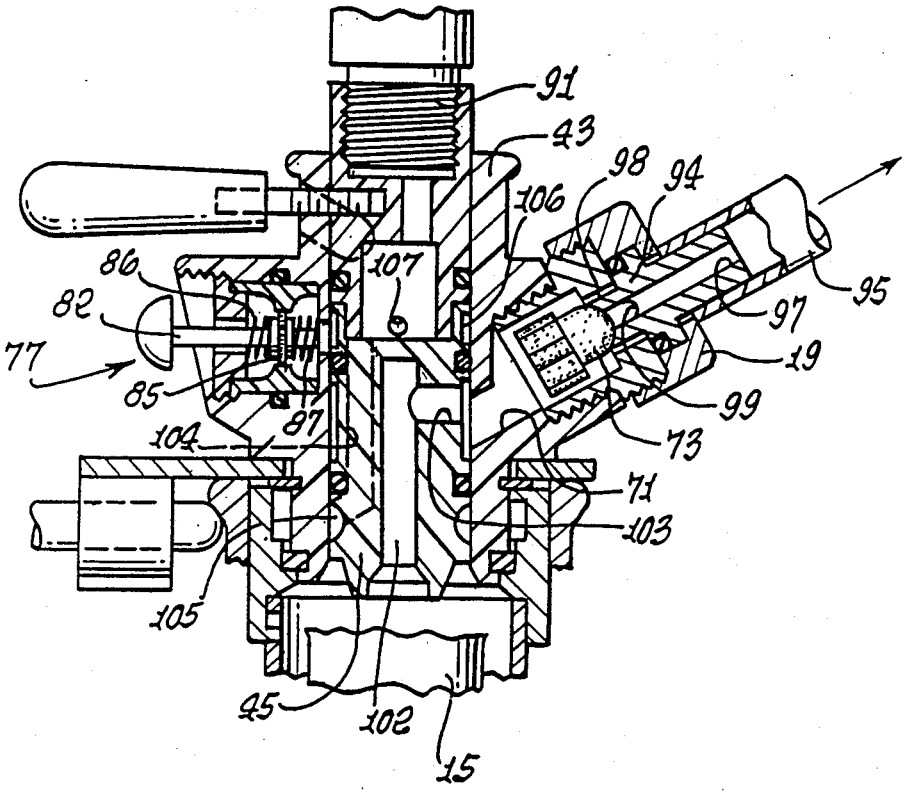

90
96
92
95
24
91
43
16
19
11
23
12
14
33

KEG TAPPER

BACKGROUND OF THE INVENTION

This invention relates to liquid dispensing apparatus, sometimes referred to as keg tappers. Present day beer kegs typically are made of metal and have a neck at one end for engagement with a tapper for dispensing beer from the keg. One such apparatus is shown in applicant's prior U.S. Pat. No. 3,836,053. In that earlier patent, the interior of the neck of the keg is threaded and the keg tapper has an external thread for mating with the neck thread. A closure valve is installed within the keg at the neck and provides for introduction of a gas under pressure into the keg and withdrawal of the beer from the keg, both through the keg tapper.

In an improved version of the keg neck, the threaded connection is replaced by a lug engagement with inwardly projecting lugs carried on the keg neck and mating parts carried on the tapper.

Both of these configurations have a problem in that wear or damage to the threads or lugs of the keg require scraping of the keg or rebuilding of the keg neck.

It is an object of the present invention to provide a new and improved keg tapper which is attached at a large and strong portion of the keg neck rather than to the smaller and relatively fragile threads or lugs. A further object of the invention is to provide such a keg tapper which can be attached onto the exterior of the neck rather than within the interior of the neck. An additional object is to provide such a keg tapper which will incorporate all the necessary functions as in the prior art devices, including control of inflow of gas and outflow of liquid.

It is a particular object of the invention to provide such a keg tapper which is readily positioned in place on the keg neck and tightened by a simple lever motion without requiring engagement of threads or lugs or the like. A further object is to provide such a keg tapper which can be used in the tavern configuration with a gas supply from a storage bottle or the like, and in the picnic configuration with gas supply from a hand pump mounted on the keg. Another object of the invention is to provide such a keg tapper incorporating a relief valve which is operated by pressure from within the keg tapper and which is operated manually from the exterior of the keg tapper.

These and other object, advantages, features and results will more fully appear in the course of the following description.

SUMMARY OF THE INVENTION

A keg tapper for use with a keg having a neck with a closure valve carried therein with the neck having a flange and tapered edge. The keg closure valve includes a seal for the interior of the tube which extends to near the bottom of the keg for beer withdrawal and an outer seal around the tube for gas under pressure to enter the keg.

One feature of the invention includes a tapper with a body having an axial bore and a plate for resting on the neck of the keg, with at least three bosses on the tapper body for engaging the keg neck flange tapered edge at spaced locations. A lever means is carried in the tapper body for moving one of the bosses toward and away from the neck for clamping the tapper to the keg and moving the tapper and the plunger within the body core downward toward the inner seal of the keg closure valve. Another feature is the provision of another lever means for moving the plunger within the body downward in the keg neck to open the inner seal and provide an outward fluid flow path and to open the outer seal and provide for gas flow into the keg.

Another feature is the provision of interchangeable plungers in the tapper body with one plunger suitable for the tavern configuration operation and the other plunger suitable for the picnic configuration operation.

Another feature is the provision of an escape valve which can be manually operated from the exterior and also operated by excess pressure from the interior of the keg.

BRIEF DESCRIPTION OF THE DRAWINGS

FIG. 5 is a sectional view taken along the line 5—5 of FIG. 2;

FIG. 7 is an enlarged partial sectional view of the tapper of FIG. 6.

DESCRIPTION OF THE PREFERRED EMBODIMENTS

Figure 1:
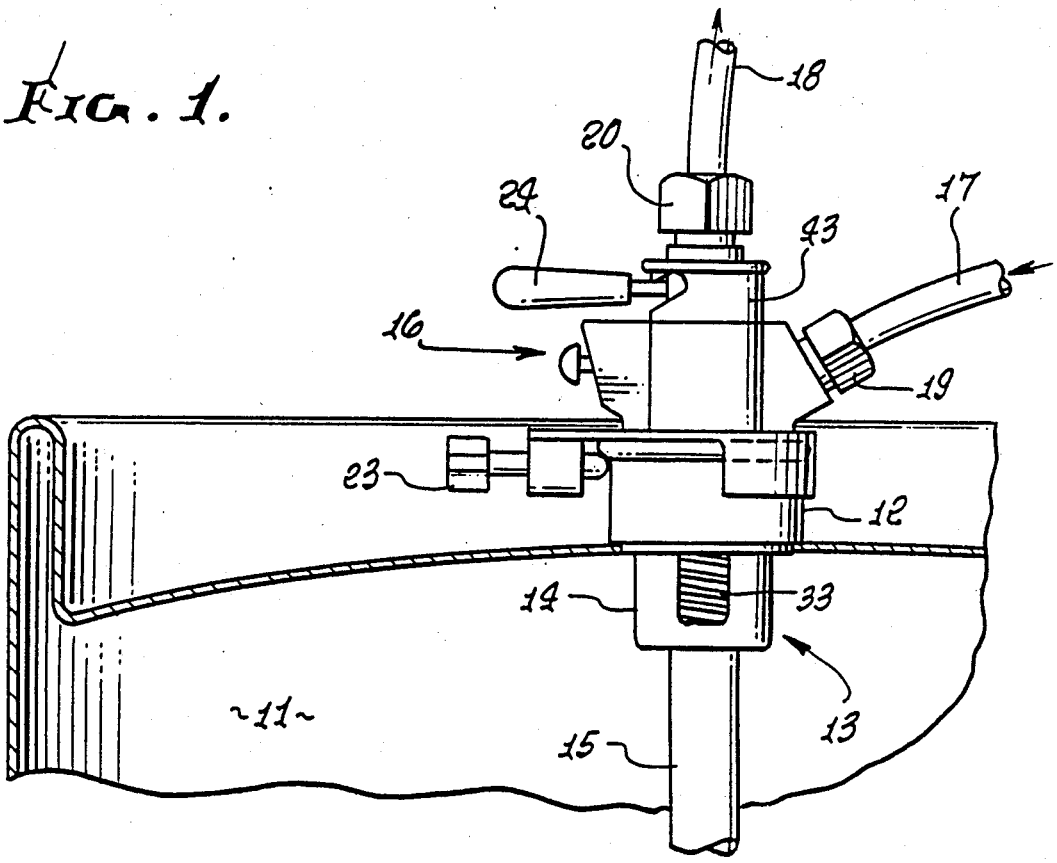
FIG. 1 is a partial side view of a keg with a keg tapper mounted thereon in the tavern configuration, the tapper incorporating the presently preferred embodiment of the invention.

A keg and tapper are shown in the tavern configuration in FIG. 1. The keg 11 has a neck 12 fixed thereto, with a closure valve 13 within the keg and carried in the neck 12. The closure valve includes a tube carrier 14 and a tube 15 depending from the tube carrier. A keg tapper 16 is mounted in the neck 12, with a line 17 from a gas pressure source and a line 18 to a liquid dispenser attached to the tapper by nuts 19, 20 respectively. The tapper 16 is positioned on the neck 12 and fixed in place by rotating a lever 23, and then the tapper is further actuated by rotating another lever 24. The function of these levers will be described in conjunction with FIGS. 2–5.

Figure 2:
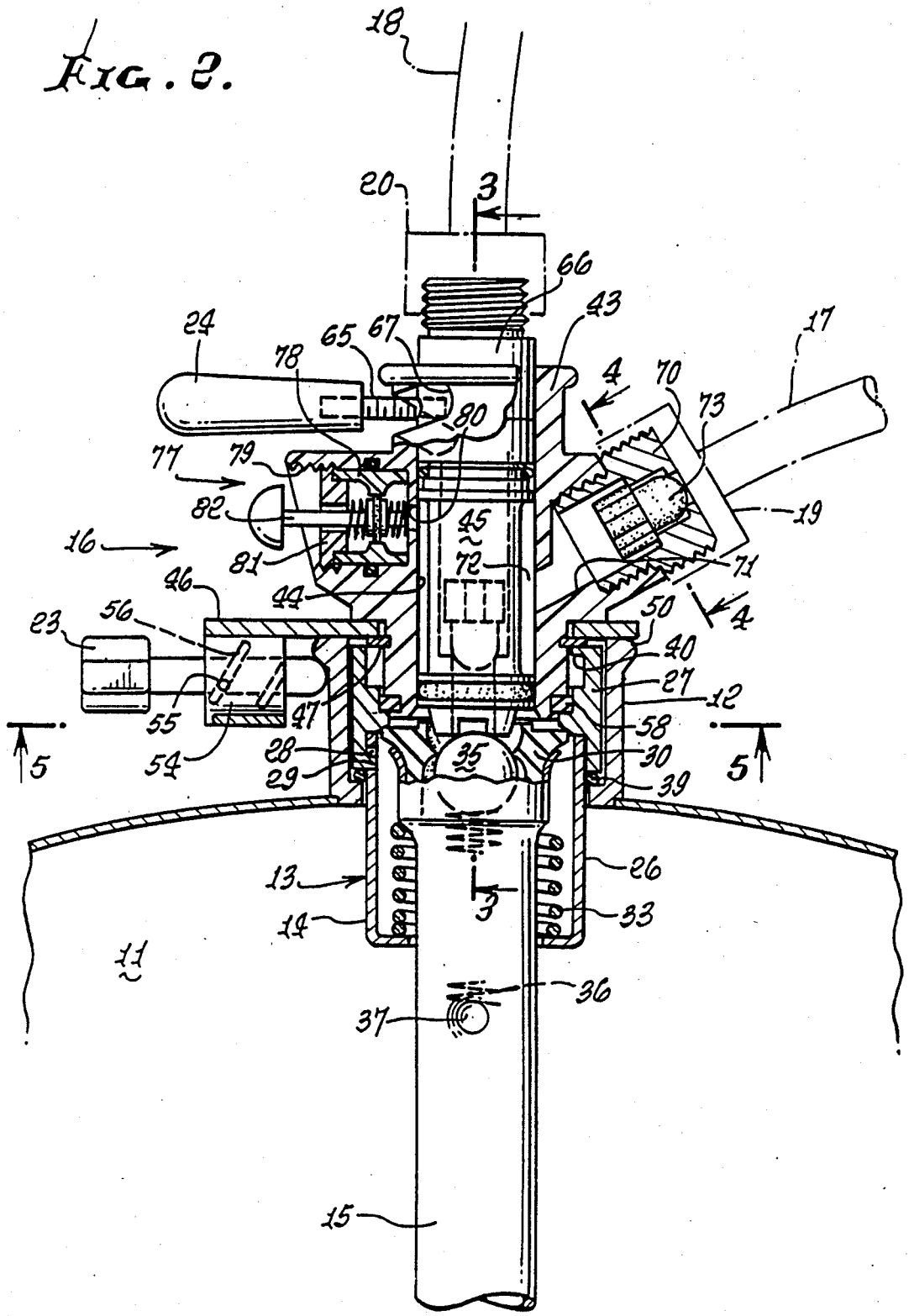
FIG. 2 is an enlarged sectional view of the tapper of FIG. 1.

The closure valve 13 of the keg is shown in greater detail in FIG. 2. The tube carrier 14 is formed of two parts, a cup 26 and a sleeve 27, with the cup having a plurality of J-slots 28 in which bayonet projections 29 of the sleeve are engaged for joining the cup and sleeve. An annular seal 30 is fixed in the upper end of the tube 15, typically by adhesive bonding, with an outer conical section 31 of the seal 30 engaging a conical valve seat 32 in the sleeve 27. The tube 15 is urged upward by a spring 33 bringing the seal 30 into engagement with the valve seat 32.

A ball valve member 35 is urged upward by a spring 36 positioned within the tube 15 between the ball and a dimple 37 in the tube, bringing the ball 35 into engagement with an inner seat 38 of the annular seal 30. When the keg is being filled and transported, the ball engages the annular seal and the annular seal engages the tube carrier so that the neck is sealed.

The tube carrier 14 is mounted in the neck in the conventional manner with a plurality of outwardly directed lugs at the outer end of the sleeve 27 engaging mating slots in the interior of the neck 12, and with an O-ring seal 39 between the sleeve and neck. The sleeve 27 also has a plurality of inwardly directed lugs 40 at the outer end thereof, which lugs are intended for engagement by the conventional keg tapper. It is these lugs which are worn or damaged in use thereby requiring scraping of the keg or rebuilding of the closure valve.

The keg tapper 16 includes a body 43, typically of molded plastic, with an axial bore 44 therethrough and a plunger 45 slidably positioned in the bore. A plate 46 is attached at the lower end of the body 43 by a snap ring 47 or alternatively by a threaded engagement.

The neck 12 of the keg has a flange 50 at the outer end of the neck, which flange has a tapered edge. The plate 46 of the tapper body is made triangular in the embodiment illustrated with fixed bosses 51 at two corners and a moveable boss 52 carried at the third corner. The bosses are arranged to engage the tapered edge of the neck flange at spaced locations, as illustrated in FIG. 5. The boss 52 is at the inner end of a plunger 53 which may be rotated in a bracket 54 of the plate, by the lever 23. A radial pin 55 projects outward from the plunger 53 into a helical groove 56 in the bracket 54 so that rotation of the plunger 53 also moves the plunger axially toward and away from the keg neck.

In operation, the plunger is moved outward, the tapper is positioned on the neck of the keg, with the plate 46 resting on the head of the neck, and with the bosses 51, 52 engageable with the tapered edge of the flange 50. In the preferred embodiment illustrated, there is an elliptical opening 57 in the plate 46 permitting the lower end of the keg body 43 to be positioned within the tube carrier sleeve 27 when the plate bosses are engaging the neck 12. A seal ring 58 is carried at the lower end of the tapper body 43 for engaging the tube carrier sleeve 27.

After positioning the tapper on the neck as described above, the lever 23 is rotated to advance the plunger 53 and engage the bosses 51, 52 with the tapered edge of the keg neck flange. This action produces a downward motion of the tapper, locks the tapper in position on the neck, and moves the lower end of the tapper plunger 45 toward the ball 35.

The lever 24 is mounted on a pin 65 which is fixed in a sleeve 66 fixed at the upper end of the plunger 45, with the pin projecting axially from the sleeve and riding in a helical groove 67 in the body 43. A check valve 68 is positioned within the passage 61 for permitting upward flow through the passage while blocking downward flow.

A nipple 70 is inserted into a lateral passage 71 for receiving the nut 19 and connecting the line 17 to the annular space formed by an annular groove 72 on the plunger 45. The nipple may be held in place by threads as shown in FIG. 2, or by a pin, or otherwise as desired. A check valve 73 is carried within the nipple 70 for permitting gas flow into the tapper from the line 17 while blocking gas flow from the tapper into the line 17. An O-ring seal 74 is carried in an annular groove at the lower end of the plunger 45.

Figure 3:
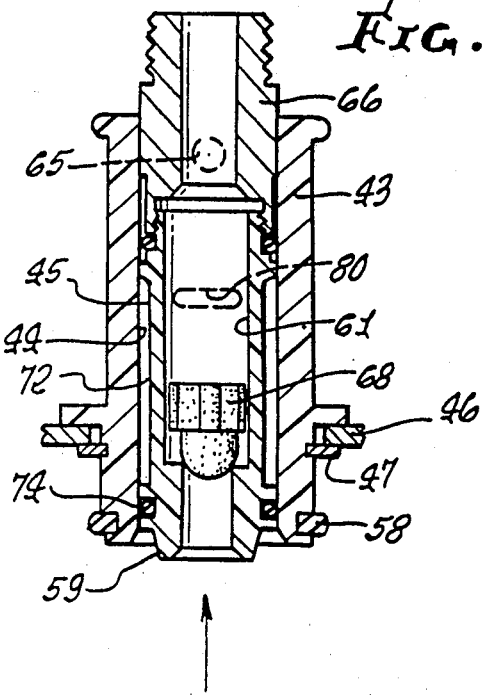
FIG. 3 is a partial sectional view taken along the line 3—3 of FIG. 2.
Figure 4:
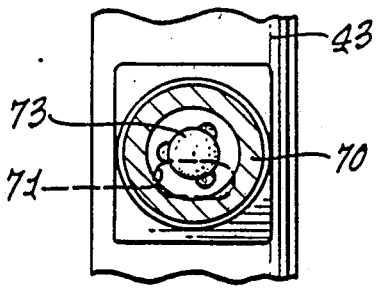
FIG. 4 is a partial sectional view taken along the line 4—4 of FIG. 2.
Figure 2A:
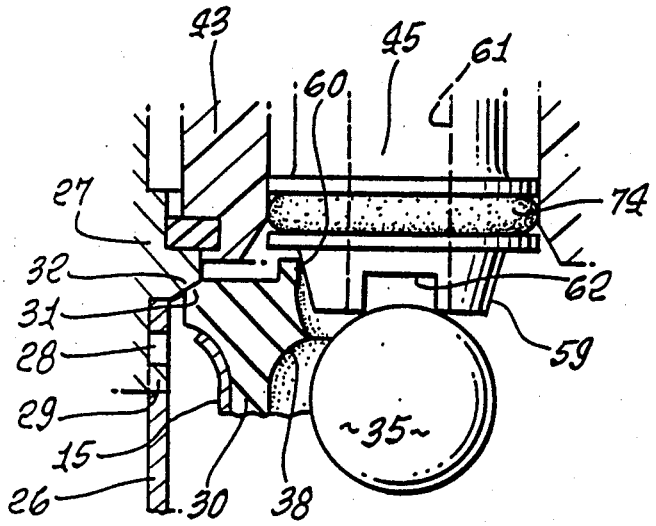
FIG. 2*a* is an enlarged partial sectional view of FIG. 2 showing the operation with the tapper attached to the neck and the plunger of the tapper depressed to open the inner seal providing the liquid flow path.

When the tapper is attached to the neck of the keg by rotating the lever 23, as described above, the plunger is in the upper position with the O-ring 74 above the lower end of the body 43, as seen in FIGS. 2 and 3. Manual rotation of the lever 24 rotates the plunger and also moves the plunger axially downward as the pin 65 moves through the helical groove 67. The plunger 45 has a frustro-conical lower end 59, which engages the ball 35, moving the ball away from the annular seal 30. The plunger end 59 also functions as a valve member as it engages the annular seal 30 at the seat 60, providing sealing engagement between the plunger and the seal. The plunger 45 has an axial passage 61 and a radial opening 62 at the lower end. A liquid flow path is provided from the tube 15, between the ball 35 and the inner seat 38, through the radial passages 62, upward through the axial passage 61, and out the line 18. The seal between the plunger end 59 and the seat 60 prevents fluid flow from the keg upward around the plunger, and the seal between the conical section 31 of the seal 30 and the seat 32 prevents fluid flow from the keg around the tube 15. See FIG. 2*a*.

Figure 2B:
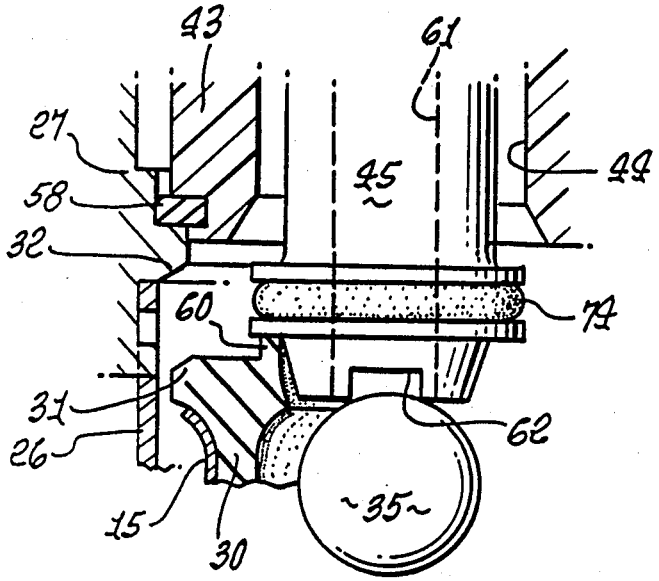
FIG. 2*b* is a view similar to that of FIG. 2*a* also showing the plunger of the tapper depressed to open the outer seal for the gas flow path.

This downward movement of the plunger also forces the annular seal 30 and the tube 15 downward against the urging of the spring 33 and moves the conical section 31 of the seal away from the valve seat 32, as shown in FIG. 2*b*. This movement also brings the O-ring 74 at the lower end of the plunger 45 downward away from the bore 44 in the tapper body. This creates.a flow path from the line 17 past the check valve 73 and through the passage 71 into the annular space 72, downward between the O-ring 74 and valve seat 32, past the annular seal 30 around the tube 15 and into the upper portion of the keg. The barrel with tapper installed in now ready for use. A supply of gas under pressure is connected to the line 17 and the control valve on this supply is opened. The line 18 is connected to the conventional dispensing nozzle and liquid from the keg is withdrawn by opening the valve at the dispensing nozzle.

A double acting relief valve 7 is provided on the body of the tapper. In the embodiment illustrated, a sleeve 78 is positioned in lateral passage 79 of the body, preferably with an O-ring seal between the sleeve and the body. An opening 80 is provided in the wall of the body for communication between the bore 44 and the passage 79. The sleeve is held in position by a disk 81 which is threadedly inserted in the passage 79, with a plunger 82 slideably positioned in the disk 81. Alternatively the disk may be adhesively bonded in place. A seal ring 85 is carried on the plunger 82 and engages a restricted zone in the sleeve 78. A spring 86 is positioned on the plunger 82 between the seal ring 85 and the disk 81, and another spring 87 is carried on the plunger between the seal ring 85 and the body 43.

Under normal operating conditions, the seal ring 85 is in sealing engagememt with the sleeve 78. If the pressure within the tapper body increases beyond a predetermined amount, the spring 86 will be compressed permitting the plunger to move outward and vent the pressure. Alternatively, the plunger 82 can be manually pushed inward, compressing the spring 87 and venting the bore 44.

Figure 6:
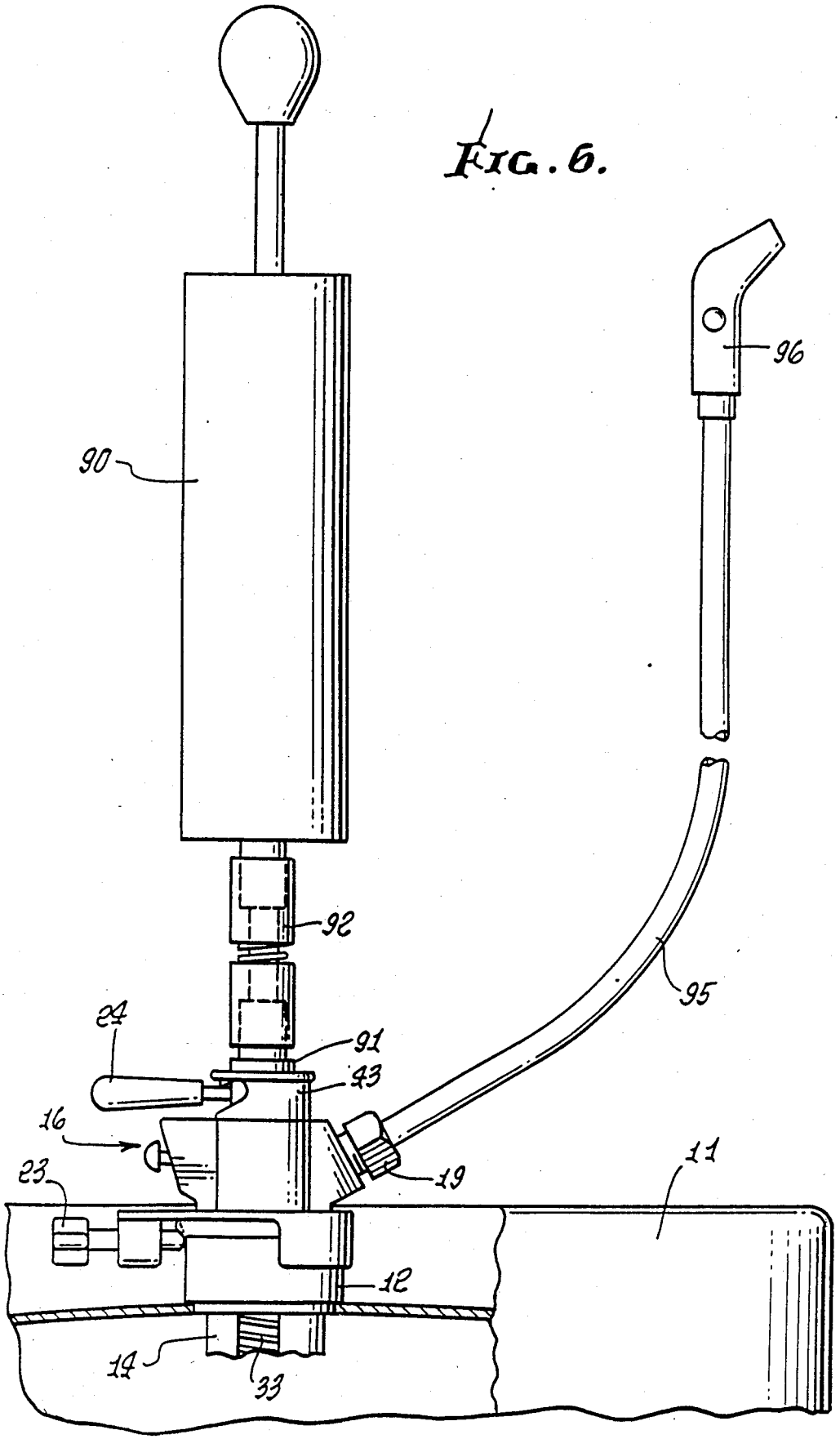
FIG. 6 is a view similar to that of FIG. 1 showing the picnic configuration.

The line configuration shown in FIGS. 1–5 is usually referred to as the tavern configuration, which operates with a tank of compressed gas. An alternative configuration is shown in FIG. 6 and 7, sometimes known as the picnic configuration, with the gas pressure provided by a hand pump 90. In the illustrated embodiment, the pump is coupled to a sleeve 91 at the upper end of the tapper by a flexible coupling 92. The construction and operation of the picnic configuration is the same as that of the tavern configuration with the exceptions to be described. An insert 94 is provided within the the nut 19 for connecting a line 95 to the lateral passage 71. A dispensing nozzle 96 is carried at the outer end of the line 95. The insert 94 has a central passage 97, which terminates in a tip 98 having a plurality of slots 99. The end of the tip engages the check valve 73 and holds the valve in the open position. This provides an outward flow path of liquid from the the passage 71, around the check valve 73 through the openings 99 and the axial passage 97 into the line 95.

The flow passages in the plunger 45 are arranged differently for the picnic configuration. An axial passage 102 in the plunger is opened at the lower end but closed at the top, and communicates with a lateral passage 103. Another passage 104 parallel to the passage 102 provides a flow path from the upper end of the plunger to an annular groove 105 adjacent the lower end of the plunger. An annular groove 106 and a radial passage 107 provide a flow path from the interior of the keg to the relief valve 77.

The installation and operation of the keg tapper of FIGS. 6 and 7 is the same as that of the tapper of FIGS. 1–5 except for the change in location of the inlet and outlet lines. With the tapper mounted on the neck, downward movement of the plunger opens the inner flow path of the keg closure valve, as shown in FIG. *2a*, and opens the outer flow path of the keg closure valve, as shown in FIG. *2b*, with the annular groove 105 exposed below the lower end of the body 43 permitting gas flow downward from the pump through the coupling 92 and sleeve 91, the passage 104 and groove 105, between the conical section 31 and seat 32, and into the keg around the tube 15. The liquid flow path is upward from the tube 15, through the passages 102 and 103, into the passage 71 and the line 95.

Thus it is seen that the keg tapper of the invention, in both disclosed embodiments, provides an easy and secure arrangement for attaching the tapper to the keg neck, with the attachment being made to a rugged and substantial portion of the neck. With this arrangement, some deforming of the neck flange will not prevent satisfactory attachment of the tapper. Also, the tapper may be used in the tavern configuration and in the picnic configuration, by merely changing the plunger and including an insert in the lateral line connection. The relief valve is a simple arrangement which provides for both automatic and manual actuation. The tapper is readily installed and removed by simple actuation of two levers without requiring any precise fitting or adjustment of thread or lug engagement.

I claim:

1. In a keg tapper for use with a keg having a neck with a closure valve carried therein, said neck having a flange with a tapered edge, said closure valve including a tube carrier fixed in said neck and having a first valve seat, a tube slidingly carried in said tube carrier, a first annular seal at the end of said tube, a first valve member positioned within said tube, a first spring for urging said first valve member against said first annular seal, and a second spring for urging said first annular seal against said first valve seat, said tapper including in combination:

a body having an axial bore and a plate for resting on said neck with at least three bosses for engaging said neck flange tapered edge at spaced locations;

a plunger slidingly disposed in said axial bore of said body with said plunger engaging said first valve member of said keg closure valve;

lever means carried on said tapper body for moving one of said bosses toward and away from said neck whereby movement of said one boss toward said neck moves said body and plunger toward said first valve member of the keg closure valve;

said plunger including a second valve member with an axial passage and at least one radial passage through said second valve member, with said radial passage providing a flow path between the interior of said tube and said axial passage of said plunger when said second valve member is moved into sealing engagement with said first annular seal and said plunger moves said first valve member away from said first annular seal;

means for moving said plunger axially in said body to bring said plunger into engagement with said first annular seal and move said tube away from said neck and move said first annular seal away from said first valve seat to provide a flow path between said valve body axial bore and the interior of said keg; and a relief valve carried in said body, said relief valve including:

sleeve means defining a flow path from said body bore to the atmosphere and having a restricted passage;

a plunger slidingly mounted in said sleeve means;

a passage seal carried by said plunger and positioned in said restricted passage in sealing relation;

a third spring positioned on one side of said passage seal and urging said passage seal away from said body; and a fourth spring positioned on the other side of said passage seal and urging said passage seal toward said body;

with said plunger exposed for manual actuation of said passage seal.

2. In a keg tapper for use with a keg having a neck with a closure valve carried therein, said neck having a flange with a tapered edge, said closure valve including a tube carrier fixed in said neck and having a first valve seat, a tube slidingly carried in said tube carrier, a first annular seal at the end of said tube, a first valve member positioned within said tube, a first spring for urging said first valve member against said first annular seal, and a second spring for urging said first annular seal against said first valve seat, said tapper including in combination:

a body having an axial bore and a plate for resting on said neck with at least three bosses for engaging said neck flange tapered edge at spaced locations;

a plunger having an interior passage and being slidingly disposed in said axial bore of said body with said plunger engaging said first valve member of said closure valve;

lever means carried on said tapper body for moving one of said bosses toward and away from said neck whereby movement of said one boss toward said neck moves said body and plunger toward said first valve member of the keg closure valve;

means for moving said plunger axially in said body to bring said plunger into engagement with said first valve member and move said first valve member away from said first annular seal, and into engagement with said first annular seal and move said tube away from said neck moving said first annular seal away from said first valve seat providing a flow path between said interior passage of said plunger and the interior of said tube and a flow path between said valve body axial bore and the interior of said keg; and a relief valve carried in said body, said relief valve including:

sleeve means defining a flow path from said body bore to the atmosphere and having a restricted passage;

a plunger slidingly mounted in said sleeve means;

a passage seal carried by said plunger and positioned in said restricted passage in sealing relation;

a third spring positioned on one side of said passage seal and urging said passage seal away from said body; and a fourth spring positioned on the other side of said passage seal and urging said passage seal toward said body;

with said plunger exposed for manual actuation of said passage seal.

3. In a keg tapper for use with a keg having a neck with a closure valve carried therein, said neck having a flange with a tapered edge, said closure valve including a tube carrier fixed in said neck and having a first valve seat, a tube slidingly carried in said tube carrier, a first annular seal at the end of said tube, a first valve member positioned within said tube, a first spring for urging said first valve member against said first annular seal, and a second spring for urging said first annular seal against said first valve seat, said tapper including in combination:

a body having an axial bore and a plate for resting on said neck with at least three bosses for engaging said neck flange tapered edge at spaced locations;

a plunger having first and second passages and being slidingly disposed in said axial bore of said body with said plunger engaging said first valve member of said closure valve;

lever means carried on said tapper body for moving one of said bosses toward and away from said neck whereby movement of said one boss toward said neck moves said body and plunger toward said first valve member of the keg closure valve;

means for moving said plunger axially in said body to bring said plunger into engagement with said first valve member and move said first valve member away from said first annular seal, and into engagement with said first annular seal and move said tube away from said neck moving said first annular seal away from said first valve seat providing a flow path between said first passage of said plunger and the interior of said tube and a flow path between said second passage of said plunger and the interior of said keg;

means defining an axial inlet in said plunger and a lateral outlet from said body bore;

means for attaching a pressure gas source to said axial inlet means; and means for attaching a liquid flow control means to said lateral outlet means;

with said plunger positioned in said axial bore and having said first passage from a side thereof to the lower end thereof in communication with said lateral outlet means and said tube, and said second passage from the upper end thereof to a side thereof in communication with said means for attaching a pressure gas source and the interior of said keg around said tube.

* * * * *